US008821302B1

(12) United States Patent
Morgan

(10) Patent No.: US 8,821,302 B1
(45) **Date of Patent: *Sep. 2, 2014**

(54) ROTATABLE AMUSEMENT APPARATUS

(71) Applicant: Richard T. Morgan, Scottsdale, AZ (US)

(72) Inventor: Richard T. Morgan, Scottsdale, AZ (US)

(73) Assignee: Richard T. Morgan Family Trust, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/175,544

(22) Filed: Feb. 7, 2014

Related U.S. Application Data

(63) Continuation of application No. 13/960,022, filed on Aug. 6, 2013, now Pat. No. 8,651,968.

(51) Int. Cl.
*A63G 1/16* (2006.01)
*A63G 1/12* (2006.01)

(52) U.S. Cl.
USPC ..... 472/19; 472/20

(58) Field of Classification Search
USPC ..... 472/1, 14, 18–21, 121, 135, 136, 137
See application file for complete search history.

(56) References Cited

U.S. PATENT DOCUMENTS

| | | | | |
|---|---|---|---|---|
| 1,693,724 | A | | 12/1928 | Morris |
| 1,792,073 | A | | 2/1931 | Clark |
| D176,401 | S | | 12/1955 | Bauer |
| 2,804,123 | A | | 8/1957 | Kling |
| 3,043,590 | A | | 7/1962 | Horowitz |
| 3,365,194 | A | | 1/1968 | Strickland, Jr. |
| 3,509,659 | A | | 5/1970 | Kau |
| 3,758,108 | A | * | 9/1973 | Tada ..... 472/5 |
| 3,785,641 | A | | 1/1974 | Muffly |
| 5,330,390 | A | | 7/1994 | Liebert et al. |
| 5,433,682 | A | | 7/1995 | Fermaglich et al. |
| 5,480,355 | A | | 1/1996 | Miller |
| 5,720,524 | A | | 2/1998 | Hall |
| 5,935,010 | A | | 8/1999 | Clarke |
| 6,319,135 | B1 | | 11/2001 | Monson |
| 6,342,013 | B1 | | 1/2002 | Irelan |
| 6,428,451 | B1 | | 8/2002 | Hall |
| 6,533,672 | B1 | | 3/2003 | Keller et al. |

* cited by examiner

*Primary Examiner* — Kien Nguyen
(74) *Attorney, Agent, or Firm* — Parsons & Goltry; Michael W. Goltry; Robert A. Parsons

(57) ABSTRACT

An amusement apparatus includes an elongate member having an upper extremity and a lower extremity with a pivot point. A self-contained child-supporting assembly is mounted to the elongate member between the upper and lower extremities for rotation and includes a seat to receive a child in a sitting position, handles to be taken up by hand by a child seated on the seat, and footrests to provide foot support for a child seated on the seat. A leveraging arm extends from the upper extremity of the elongate member to an outer end having an upright handle. The leveraging arm has a transverse handle between the upper extremity of the elongate member and the upright handle. The transverse and upright handles are available to be taken up by hand to reciprocally pivot the elongate member at the pivot point to impart rotation to the child-supporting assembly about the elongate member.

13 Claims, 10 Drawing Sheets

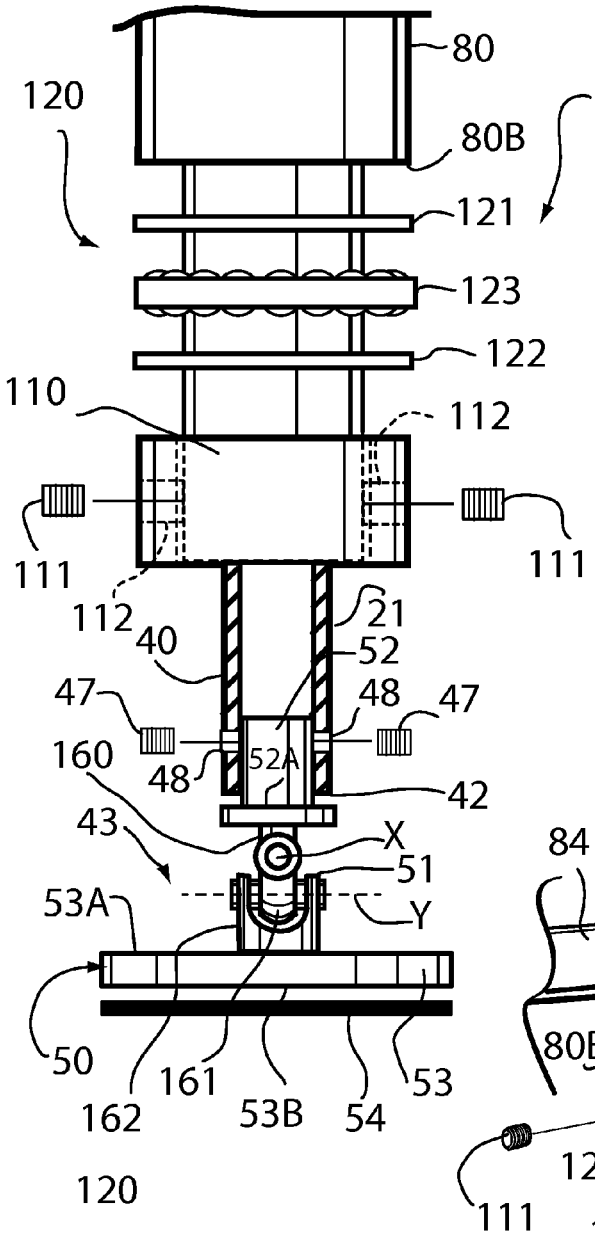
FIG. 10
FIG. 11
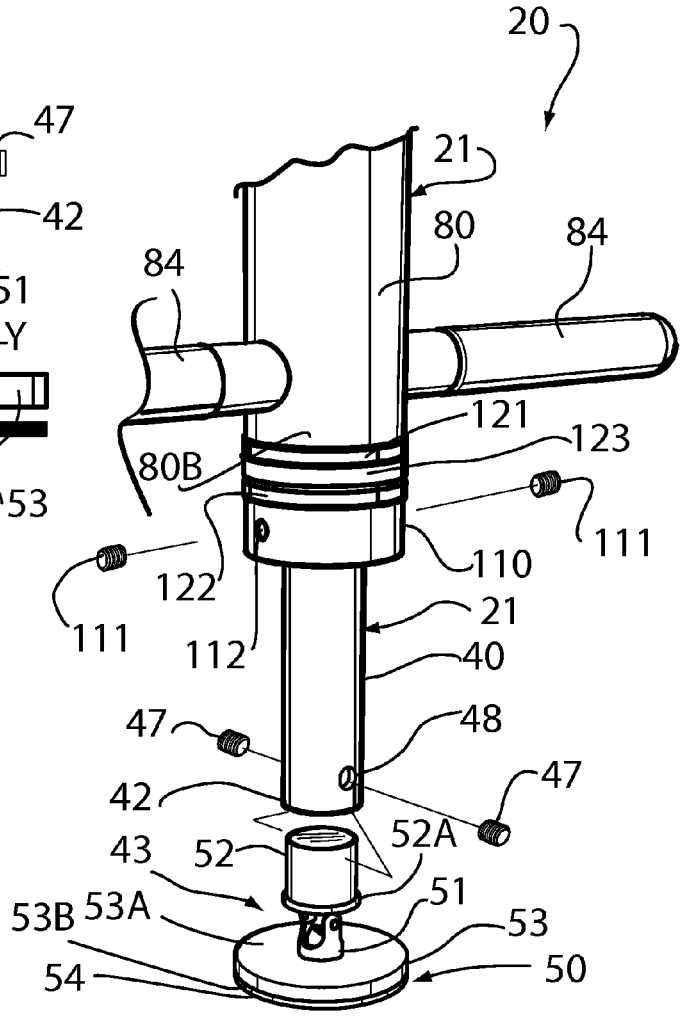

B
20
64
A
62
63
60
C
130
61
41
21
132
40
100
80A
83
83
80
22
82
81
91
84
84
80B
120
110
42
43
50
131

ROTATABLE AMUSEMENT APPARATUS

FIELD OF THE INVENTION

The present invention relates to amusement devices for children and, more particularly, to an amusement apparatus for supporting and entertaining a child through rotational movement and pivoting movement.

BACKGROUND OF THE INVENTION

Children enjoy playing on riding toys and playground equipment that move cyclical, up and down, or circular motion. The classic teeter totter remains a favorite recreational toy for children. Children enjoy the sensation of jumping off, or being lifted from, the ground. Other toys which enable a child to sit and move in a generally circular manner are also traditional favorites. Children also enjoy bouncing toys including trampolines and large bouncing balls. Children particularly enjoy riding toys which enable them to expend energy. All of these toys provide essential proprioceptic input for developing children.

Existing riding toys including teeter totters and large rotating play devices, however, have a number of drawbacks. Traditional teeter totters require two children of generally equivalent weight to operate. Teeter totters typically provide only pivotal up and down motion about a fulcrum. The fixed up and down motion of the teeter totter typically does not attract a child's attention for a long period of time. Additionally, teeter totters are typically not configured to soften the impact to the child from either end of the teeter totter contacting the ground. This often results in a jarring impact between one child and the ground when the second child lifts off the opposite end of the teeter totter. Rotating toys typically also do not include the ability for the child to move up and down. Additionally, rotating toys are often large, heavy, difficult to operate, difficult to stop and difficult to reverse in direction. Moreover, teeter totters and large rotating riding toys often have unsafe, sharp corners and edges. Some toys have attempted to combine a rotating riding toy with a single child teeter totter. Such devices often have a counterweight assembly dangerously suspended on an opposite end of the teeter totter type rod. The large and heavy counterweight assembly of such toys counteracts the movement of the child riding the toy such that the counterweight assembly swings left or right and up and down creating a safety hazard for children observing or playing nearby. Further, existing riding toys such as teeter totters and large rotatable toys are typically not suitable for home use due to their size and weight, and because such toys are not designed to softly impact the surface upon which the toys rest.

Large bouncing balls provide the ability for a child to bounce up and down and to direct the ball in different directions. However, such balls also are easily rotated, such that the handle rotates toward the surface, which often results in the child falling from the ball. The huge bouncing balls can also be difficult for a child to control and can result in the child inadvertently bouncing in an undesired direction.

Given these and other deficiencies in the art of child amusement devices of the type that may be ridden, there is a need for continued improvement in the art.

SUMMARY OF THE INVENTION

According to the principle of the invention, an amusement apparatus includes an elongate member and a self-contained child-supporting assembly. The elongate member has an upper extremity and a lower extremity with a pivot point. The child-supporting assembly is mounted to the elongate member for rotation thereabout between the upper extremity and the lower extremity. The child-supporting assembly includes a seat to receive a child in a sitting position, handles available to be taken up by hand by a child seated on the seat, and footrests available to provide foot support for a child seated on the seat. A leveraging arm extends outwardly and away from the upper extremity of the elongate member to an outer end. The leveraging arm has a transverse handle between the upper extremity of the elongate member and the outer end of the leveraging arm, and an upright handle at the outer end of the leveraging arm. The leveraging arm is available to be taken up and held at the transverse handle and the upright handle to reciprocally pivot the elongate member at the pivot point formed in the lower extremity of the elongate member to impart rotation to the child-supporting assembly about the elongate member. The upright handle is positioned above the transverse handle. The upright handle is oblique in relation to the transverse handle. The pivot point is defined by a pivot joint formed in the lower extremity of the elongate member. The pivot joint consists of a linkage assembly coupled between the lower extremity of the elongate member and a foot positionable against a support surface. The foot is a flat, rigid plate that has a top side coupled to the linkage assembly and an underside with a resilient, skid-resistant boot.

According to the principle of the invention, an amusement apparatus includes an elongate member and a self-contained child-supporting assembly. In this embodiment, the elongate member has an upper extremity and a lower extremity with a pivot point. The self-contained child-supporting assembly includes an elongate support mounted to the elongate member for rotation thereabout between the upper extremity and the lower extremity, the elongate support has an upper end directed toward the upper extremity of the elongate member and a lower end directed toward the lower extremity of the elongate member, a seat to receive a child in a sitting position rigidly affixed to the elongate support between the upper and lower ends, handles available to be taken up by hand by a child seated on the seat rigidly affixed to the elongate support near the upper end thereof, and footrests available to provide foot support for a child seated on the seat rigidly affixed to the elongate support near the lower end thereof. A leveraging arm extends outwardly and away from the upper extremity of the elongate member to an outer end. The leveraging arm has a transverse handle between the upper extremity of the elongate member and the outer end of the leveraging arm, and an upright handle at the outer end of the leveraging arm. The leveraging arm is available to be taken up and held at the transverse handle and the upright handle to reciprocally pivot the elongate member at the pivot point formed in the lower extremity of the elongate member to impart rotation to the child-supporting assembly about the elongate member. The upright handle is positioned above the transverse handle. The upright handle is oblique in relation to the transverse handle. The pivot point is defined by a pivot joint formed in the lower extremity of the elongate member. The pivot joint consists of a linkage assembly coupled between the lower extremity of the elongate member and a foot positionable against a support surface. The foot is a flat, rigid plate that has a top side coupled to the linkage assembly and an underside with a resilient, skid-resistant boot.

According to the principle of the invention, an amusement apparatus includes an elongate member and a self-contained child-supporting assembly. In this embodiment, the elongate member has an upper extremity and a lower extremity with a pivot point. The child-supporting assembly includes an elongate, tubular support, a seat, handles, and footrests. The elongate, tubular support encircles the elongate member between the upper extremity and the lower extremity and is mounted to the elongate member for rotation thereabout. The elongate, tubular support has an upper end directed toward the upper extremity of the elongate member and a lower end directed toward the lower extremity of the elongate member. The seat to receive a child in a sitting position is rigidly affixed to the elongate, tubular support between the upper and lower ends, the handles available to be taken up by hand by a child seated on the seat are rigidly affixed to the elongate, tubular support near the upper end thereof, and the footrests available to provide foot support for a child seated on the seat are rigidly affixed to the elongate, tubular support near the lower end thereof. A leveraging arm extends outwardly and away from the upper extremity of the elongate member to an outer end. The leveraging arm has a transverse handle between the upper extremity of the elongate member and the outer end of the leveraging arm, and an upright handle at the outer end of the leveraging arm. The leveraging arm is available to be taken up and held at the transverse handle and the upright handle to reciprocally pivot the elongate member at the pivot point formed in the lower extremity of the elongate member to impart rotation to the child-supporting assembly about the elongate member. Upper and lower collars on the elongate member on either side of the upper end and the lower end, respectively, of the elongate, tubular support captively retain the elongate, tubular support to the elongate member. A bearing is on the elongate member between the lower collar and the lower end of the elongate, tubular support in which the lower end of the elongate, tubular support rotates. The upper collar is releasably connected to the elongate member. The lower collar is releasably connected to the elongate member. The upright handle is positioned above the transverse handle. The upright handle is oblique in relation to the transverse handle. The pivot point is defined by a pivot joint formed in the lower extremity of the elongate member. The pivot joint is a linkage assembly coupled between the lower extremity of the elongate member and a foot positionable against a support surface. The foot is a flat, rigid plate that has a top side coupled to the linkage assembly and an underside with a resilient, skid-resistant boot.

BRIEF DESCRIPTION OF THE DRAWINGS

Referring to the drawings:

FIG. 10 is an enlarged, fragmented elevation view of the amusement apparatus first illustrated in FIG. 1 illustrating a bearing and a retention collar for rotatably coupling the child-supporting assembly to the upstanding, handled stand, and a foot assembly at a lower extremity of the upstanding, handled stand;

FIG. 11 is an enlarged, fragmented perspective view of the amusement apparatus first illustrated in FIG. 1 illustrating the bearing and the retention collar of FIG. 10 as they would appear assembled preparatory to being secured in place to the upstanding, handled stand with set screws, and further illustrating the foot assembly of FIG. 10 as it would appear detached from the lower extremity of the upstanding, handled stand.

DETAILED DESCRIPTION

Figure 1:
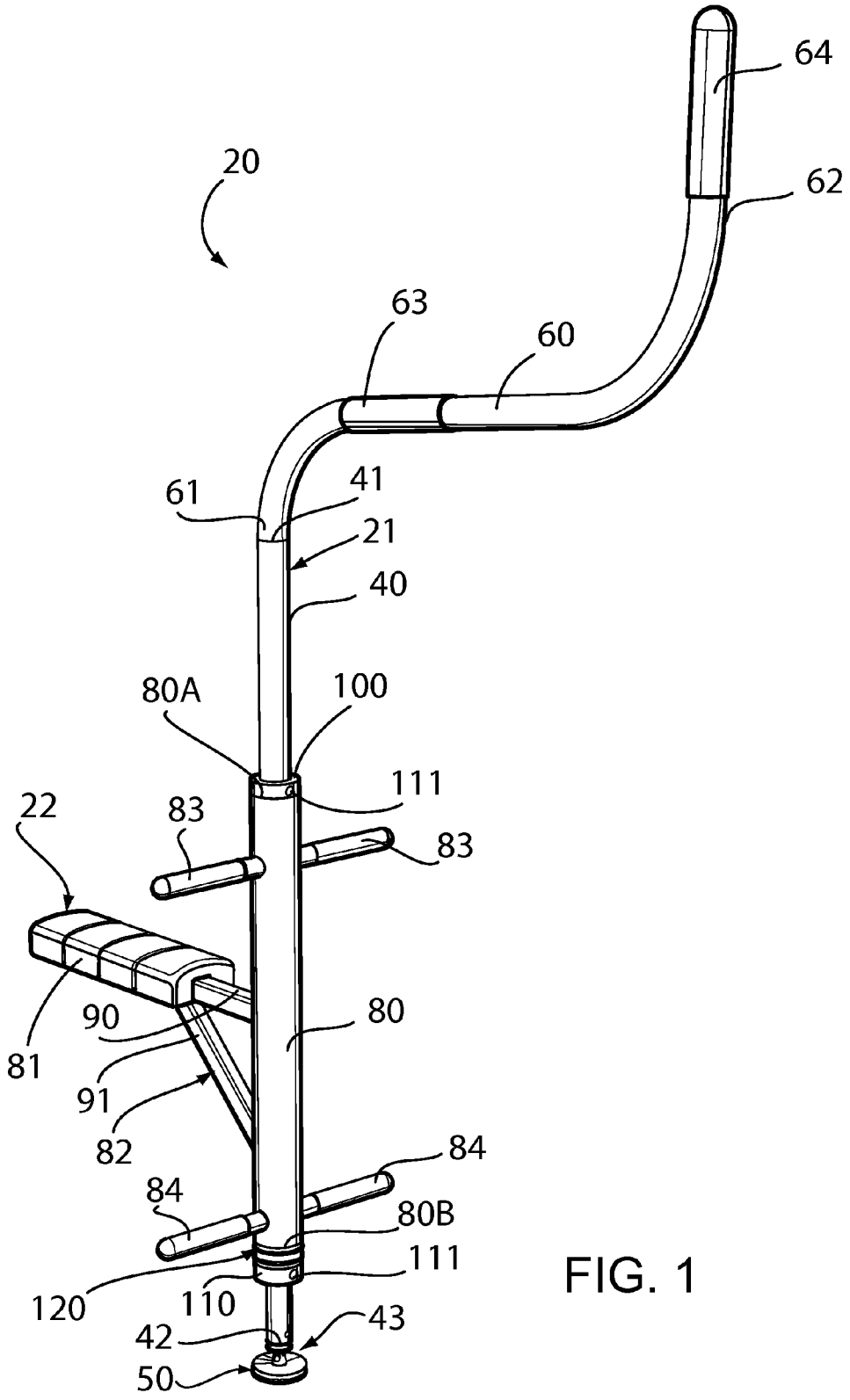
FIG. 1 is a rear perspective view of an amusement apparatus constructed and arranged in accordance with the principle of the invention, the amusement apparatus includes a self-contained child-supporting assembly rotatably mounted to an upstanding, handled stand.
Figure 2:
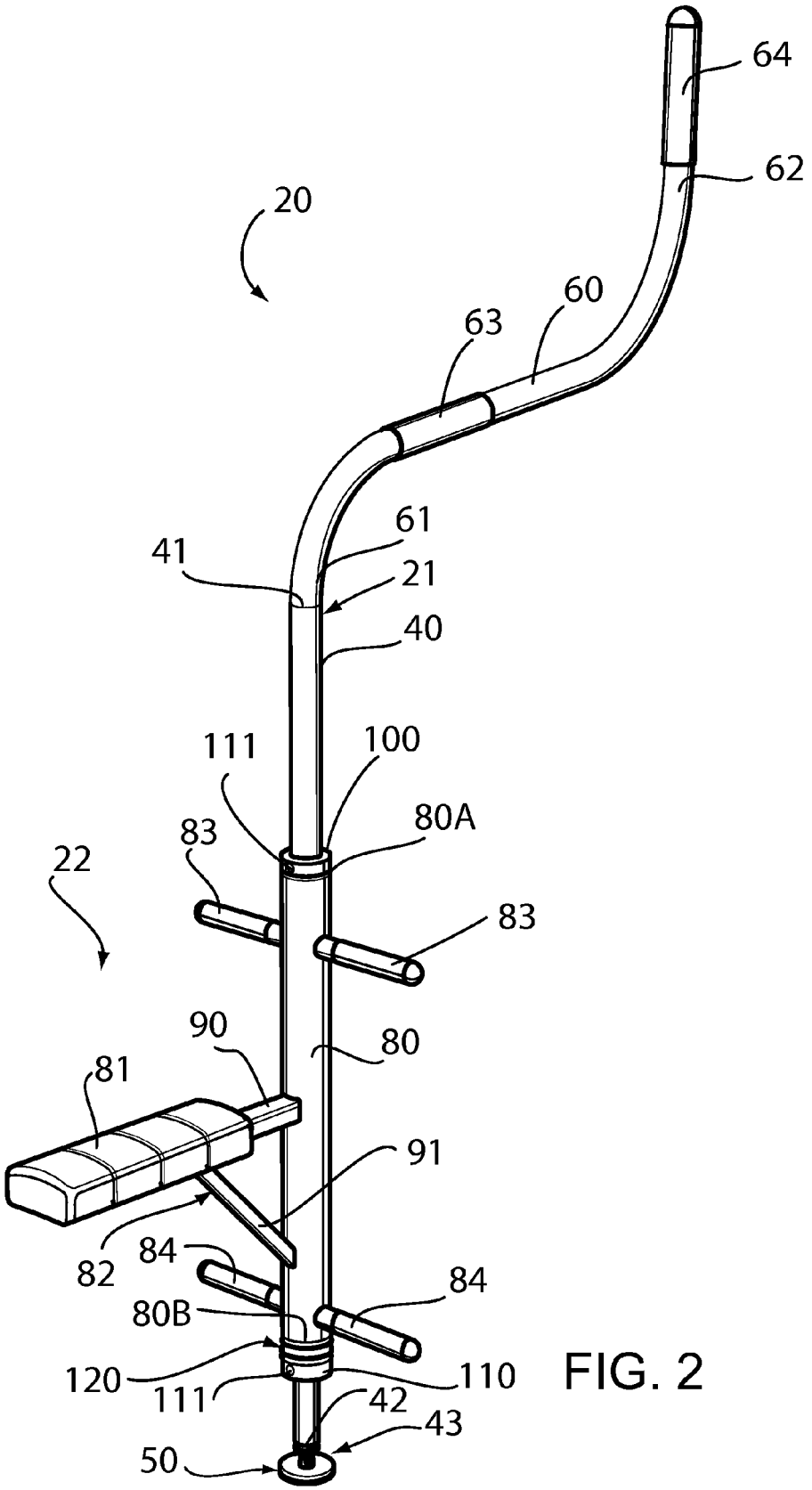
FIG. 2 is front perspective view of the embodiment of FIG. 1.
Figure 3:
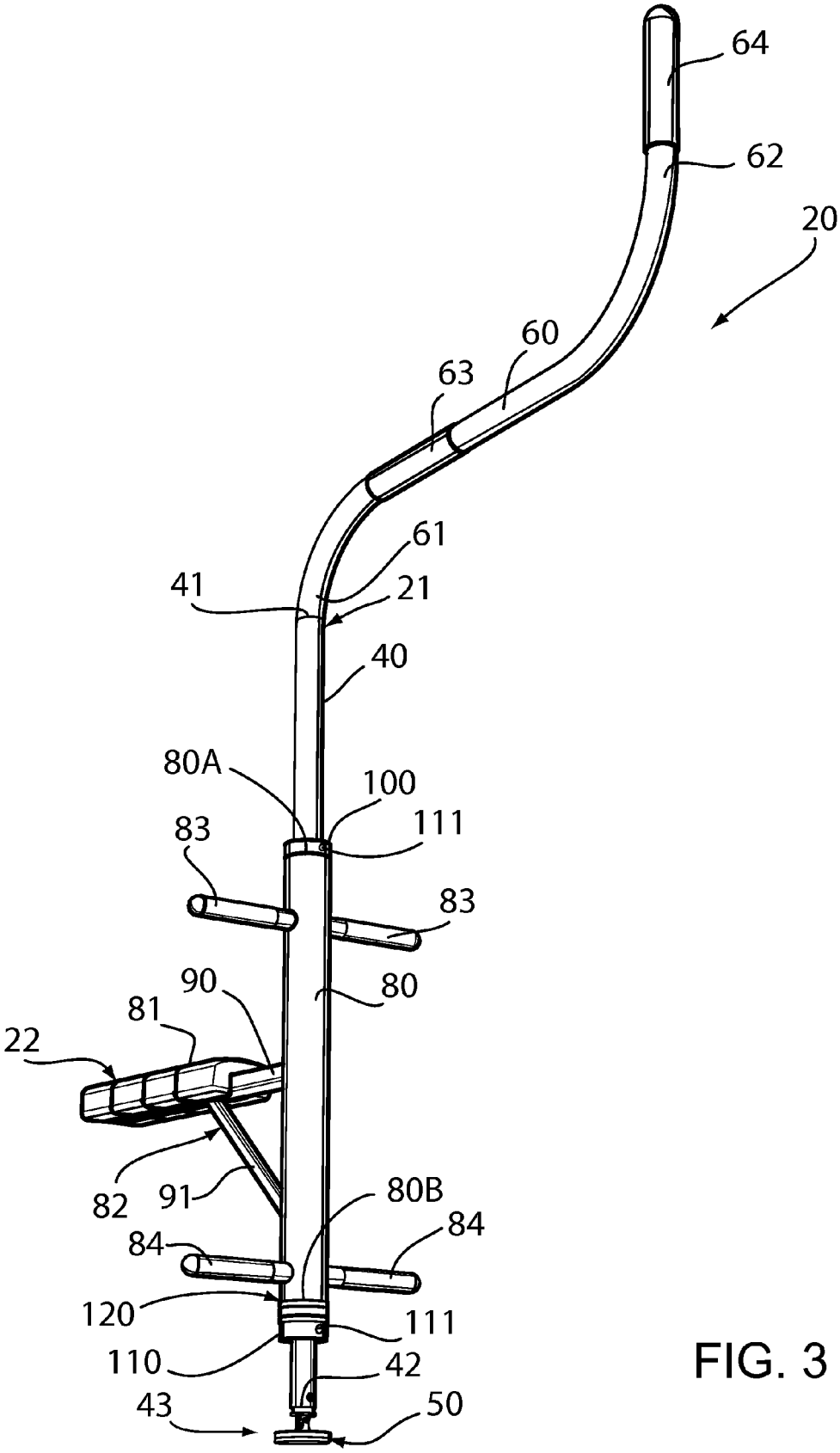
FIG. 3 is a front perspective view similar to that of FIG. 2 looking upwardly toward an underside of a seat of the child-supporting assembly of the amusement apparatus.
Figure 4:
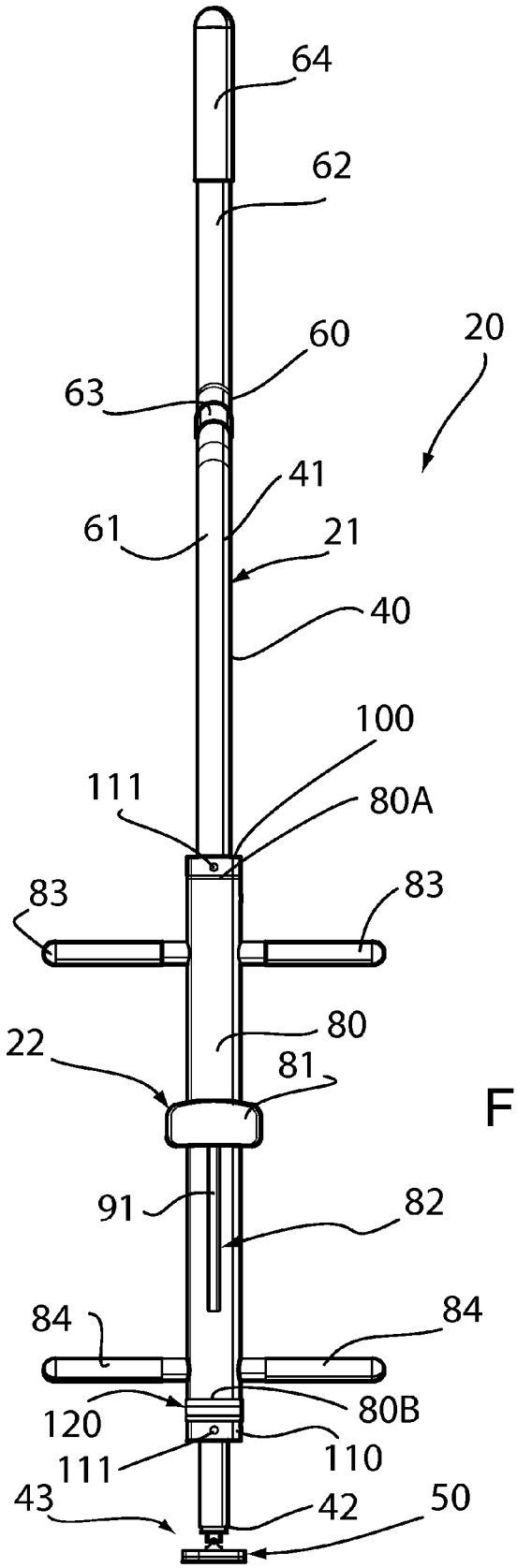
FIG. 4 is a front elevation view of the embodiment of FIG. 1.
Figure 5:
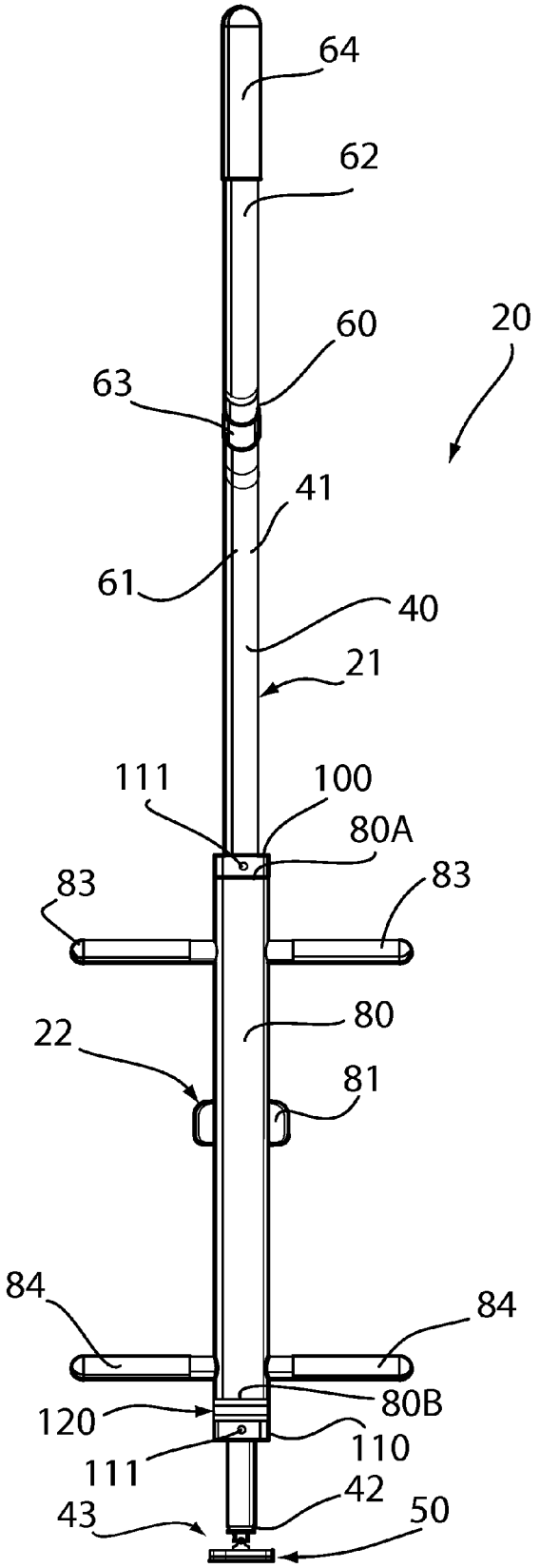
FIG. 5 is a rear elevation view of the embodiment of FIG. 1.
Figure 6:
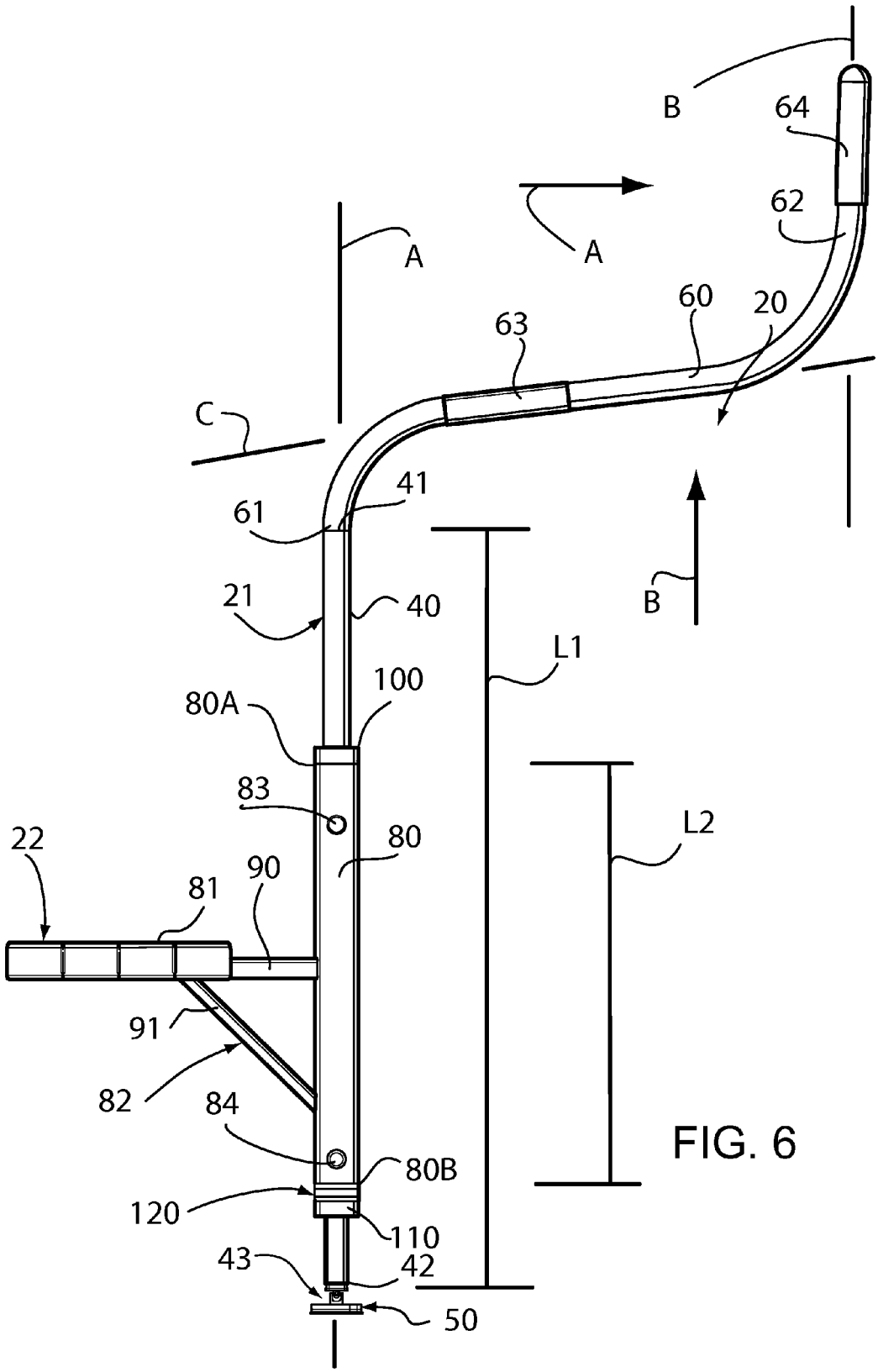
FIG. 6 is a right side elevation view of the embodiment of FIG. 1.
Figure 7:
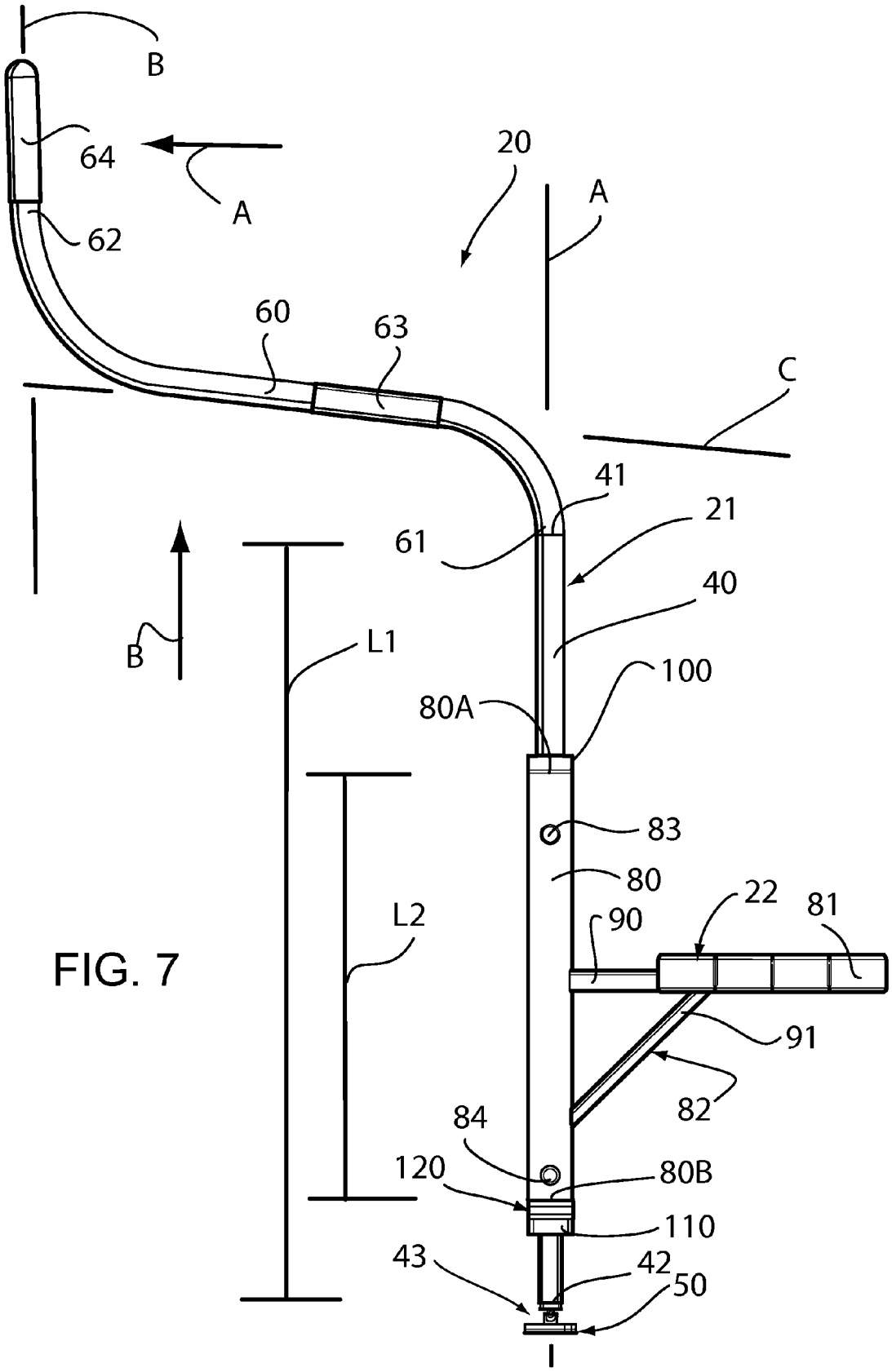
FIG. 7 is a left side elevation view of the embodiment of FIG. 1.
Figure 8:
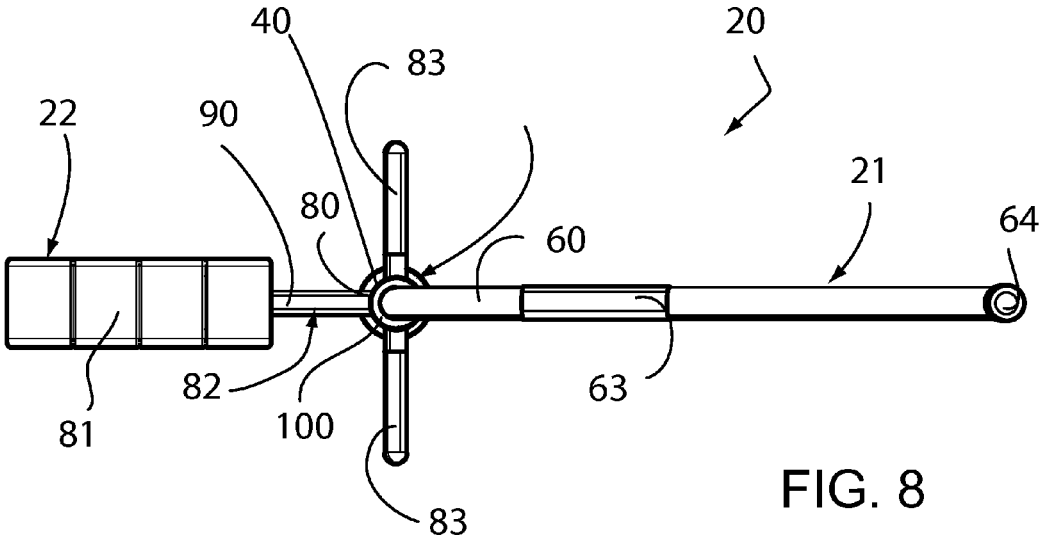
FIG. 8 is a top plan view of the embodiment of FIG. 1.
Figure 9:
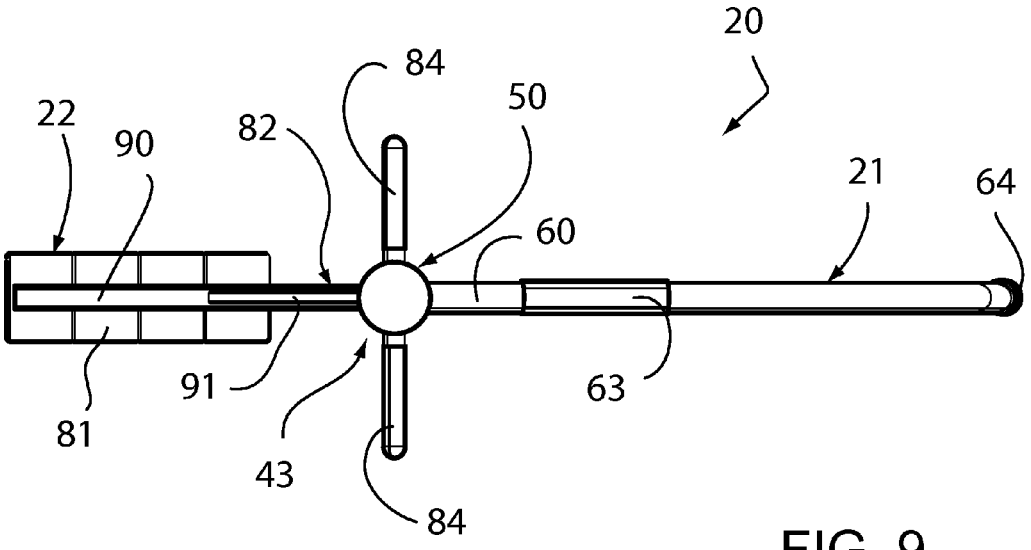
FIG. 9 is a bottom plan view of the embodiment of FIG. 1.

Turning now to the drawings, in which like reference characters indicate corresponding elements throughout the several views, attention is first directed to FIG. 1 illustrating amusement apparatus 20 constructed and arranged in accordance with the principle of the invention including an upstanding, handled support assembly or stand 21, and a self-contained, child-supporting assembly 22. Assembly 22 is mounted to stand 21 for rotation at an elevated location and is configured to receive a child in a seated or sitting position. Specifically, assembly 22 has seat 81 configured to receive a child in a seated position, handles 83 available to be taken up by hand by a child seated on seat 81, and footrests 84 available to provide foot support for a child seated on seat 81. Stand 21 is configured to be taken up by hand by a caregiver and held upright against a support surface, whereby the caregiver may act on and manage stand 21 to rotate and reciprocally pivot stand 21 to impart rotation to assembly 22 thereabout stand 21 to provide delight and amusement to a child seated on assembly 22. Rotation of assembly 22 about stand 21 not only has the benefit of providing amusement and entertainment to a child seated on seat assembly 22, but also has the benefit of providing physical therapy and physical exercise for a child seated on seat assembly 22, particularly for autistic children who respond favorably to movement provided via the movement provided by amusement apparatus 20. As such, amusement apparatus 20 is a multipurpose device useful for providing amusement and entertainment, physical therapy, and physical exercise, in accordance with the principle of the invention.

Referencing in relevant part FIGS. 1-9, stand 21 is used to manage and wield assembly 22, is fashioned of a material or a combination of materials having the inherent properties of rigidity, strength, resilience, and impact-resistance, such as wood, plastic, and preferably steel, aluminum, or other metal. Stand 21 may be integrally formed, such as through machining or molding, or may be formed of a plurality of attached parts joined together with welding, adhesive, fasteners, joinery, etc. Stand 21 consists of elongate member 40 and leveraging arm 60. Elongate member 40 has upper end or extremity 41, and opposed lower end or extremity 42. Lower extremity 42 is formed with a pivot point, denoted generally at 43, about which stand 21 is pivoted during use. Elongate member 40 is a substantial pole, which is hollow, long, strong, slender, and cylindrical, which has length L1, denoted in FIGS. 6 and 7, extending from upper extremity 41 to lower extremity 42, and which is arranged about axis A extending from upper extremity 41 to lower extremity 42 formed with pivot point 43. In a preferred embodiment, as referenced in FIGS. 6 and 7 length L1 of elongate member 40 from upper extremity 41 to lower extremity 42 formed with pivot point 43 is approximately 40 inches.

Referring in relevant part to FIGS. 10 and 11, pivot point 43 is defined by foot assembly 50 formed in lower extremity 42 of elongate member 40. Foot assembly 50 consists of pivot joint 51 coupled between block 52, configured to be releasably/removably connected to lower extremity 42 of elongate member 40, and foot 53, positionable against a support surface to provide a stable platform for amusement apparatus during normal use. In this embodiment, block 52 is inserted into lower extremity 42 of elongate member 40 until annular flange 52A of block 52 is brought into direct contact against the outer side of lower extremity 42 that sets block 52 in place in preparation for securement, and block 52 is then removably connected/secured to lower extremity 42 of elongate member with set screws 47. Set screws 47 pass through corresponding threaded holes 48 in the outer object, which in this example is lower extremity 42 of elongate member 40, and are tightened via rotation against the inner object, which in this example is block 52, which removably connects/secures block 52 to lower extremity 42 of elongate member 40.

Foot 53 is a flat, circular plate having top side 53A coupled to pivot joint 51 and underside 53B formed with an attached boot 54. Pivot joint 51, block 52, and plate 53 are preferably fashioned of steel, aluminum, or other metal to provide strength and longevity. Top side 53A and underside 53B are parallel. Boot 54 is a layer formed of a resilient, skid-resistant or non-slip material, such as rubber, e.g. Vibram brand rubber, neoprene, or other rugged, resilient material or combination of rubber or rubber-like material to provide skid-resistance for foot assembly 50 and to provide reliable and prolonged use. Boot 54 is affixed to underside 53A of foot 53 with mechanical fasteners or adhesive, and may be over-molded onto underside 53B of foot 53 if so desired.

Pivot joint 51 is a conventional and well-known universal joint that allows stand 21 to pivot in any direction relative to foot 53. In this example, pivot joint 51 is a linkage assembly coupled between lower extremity 42 of elongate member 40 and foot 53 that consists of hinged linkages 160, 161, and 162 that pivot about two orthogonal axes X and Y to allow stand 21 to pivot in any direction. Linkage 160 is affixed to block 52 via welding, block 52 is in turn attached to lower extremity 42 of elongate member 40 of stand 21, linkage 162 is affixed to top side 53A of foot 53 via welding, and linkage 161 between linkages 160 and 162 is concurrently hinged to linkages 160 and 162, respectively, at hinges or hinge points so as to define orthogonal pivot axes X and Y.

Referring back in relevant part to FIGS. 1-9, arm 60 is elongate and handled. Arm 60 has inner end 61 affixed to upper extremity 41 of elongate member 40 and extends angularly upward, outwardly, and away from upper extremity 41 of elongate member 40 to an opposed outer end 62 formed with upright handle 64. The juncture of upper extremity 41 of elongate member 40 and inner end 61 of arm 60 is the line of demarcation between elongate member 40 and arm 60. Arm 60 is an extension of elongate member 40, and like elongate member 40 is a substantial pole, which is long, strong, hollow, slender, and generally cylindrical, which has a length extending from inner end 61 to outer end 62 formed with upright handle 64. In this example, the overall length of arm 60 from inner end 61 to outer end 62 formed with upright handle 64 is nearly the same length as elongate member 40, preferably approximately 36-38 inches.

In addition to upright handle 64, leveraging arm 60 has transverse handle 63. Transverse handle 63 is, like upright handle 64, a defined handle, which is defined and located between, on the one hand, inner end 61 of leveraging arm 60 and upper extremity 41 and outer end 62 of leveraging arm 60 and, on the other hand, upright handle 64 at outer end 61 of leveraging arm 60. Upright handle 64 is positioned above upper extremity 41 of elongate member 40 and transverse handle 63, and also assembly 22. Transverse and upright handles 63 and 64 are elongate and suitable to be taken up by hand by a caregiver. In this example, transverse and upright handles 63 and 64 are rubberized or rubber-like applications or sleeves on arm 60 suitable for comfortable gripping by hand. Arm 60 is thus available to be taken up and held at transverse handle 63 and upright handle 64 to reciprocally pivot and rotate elongate member 40 at pivot point 43 formed in lower extremity 42 of elongate member 40 to impart rotation to assembly 22 about elongate member 49.

Figure 12:
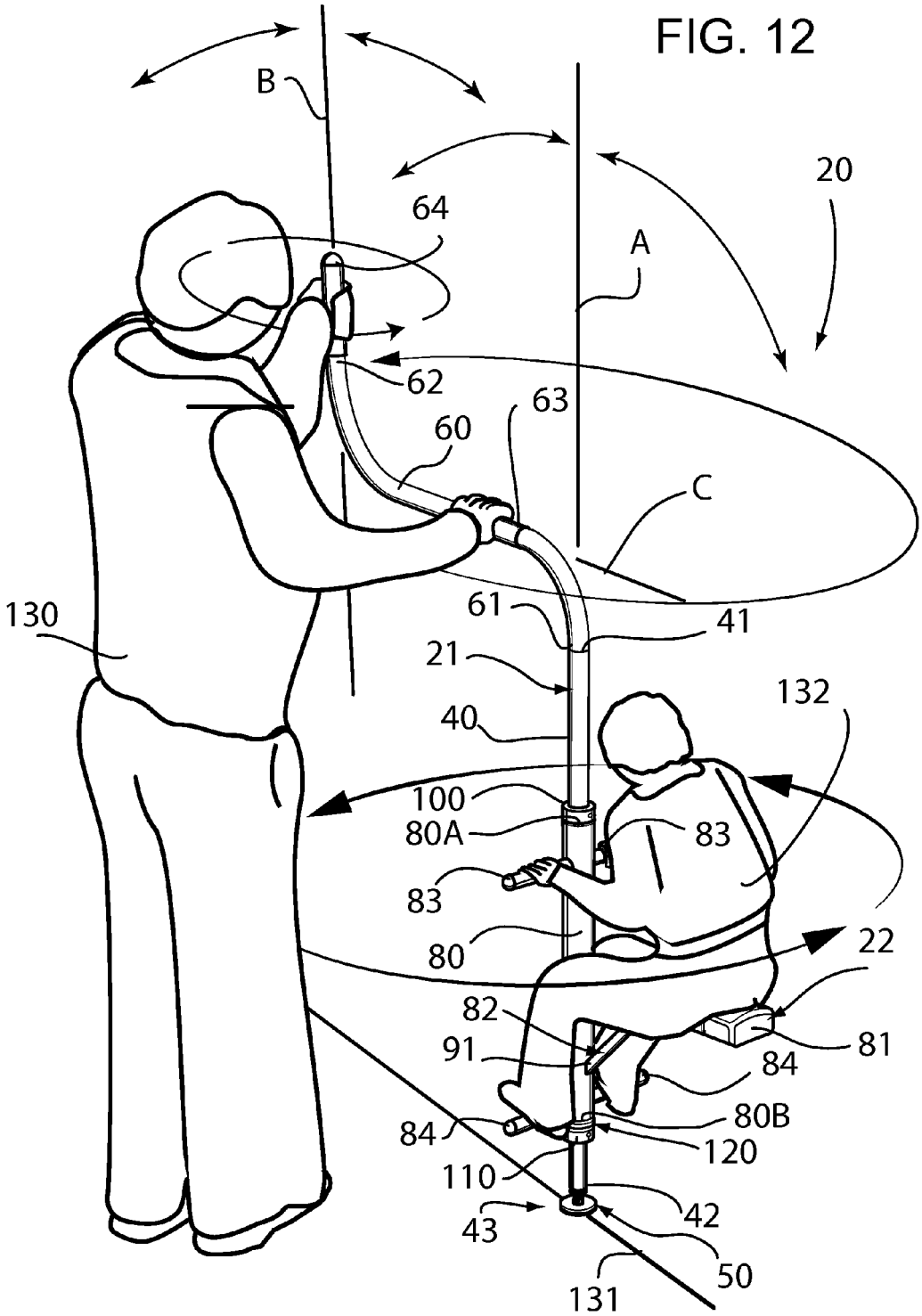
FIG. 12 is a perspective view of the amusement apparatus first illustrated in FIG. 1 shown as it would appear in use providing amusement to a child.

Transverse handle 63 is located near inner end 61 of arm 60, and is closer to inner end 61 than to outer end 62 formed with upright handle 64. Referencing FIGS. 6, 7, and 12, upright handle 64 is arranged about axis B and transverse handle is arranged about axis C. Looking to FIGS. 6 and 7, axis B of upright handle 64 is spaced a distance outwardly or otherwise away from axis A of elongate member 40. In this embodiment, upright handle 64 is oblique relative to axis A of elongate member 40, which means in this example that upright handle 64 slants slightly outwardly approximately 3 degrees from vertical away from axis A of elongate member 40 in the direction of arrowed line A so that while being nearly or substantially parallel relative to axis A is nevertheless neither parallel nor perpendicular relative to axis A of elongate member 40.

A transverse portion or length of the overall length of arm 60 defines or otherwise extends along axis C, in a direction from inner end 61 to outer end 62, about which transverse handle 63 is arranged. Axis C is transverse relative to axis A and axis B and is slightly up-angled or otherwise slightly angularly disposed upwardly with respect to axis A of elongate member 40 in the direction of arrowed line B forming an inward angle between axis C and axis A of approximately 95 degrees. Axis C and transverse handle 63 are oblique relative to axis A of elongate member 40, which means in this example that axis C and transverse handle 63 slant slightly upwardly approximately 5 degrees from horizontal in the direction of arrowed line B so that while being nearly or substantially perpendicular relative to axis A are nevertheless neither perpendicular nor parallel relative to axis A of elongate member 40.

Upright handle 64 is oblique relative to axis C and transverse handle 63, which means in this example that axis B of upright handle 64 slants slightly outwardly approximately 5 degrees from perpendicular away from axis C and transverse handle 63 of arm 60 in the direction of arrowed line A, forming an inward angle between axis B and axis C and transverse handle 63 of approximately 95 degrees, so as to be neither perpendicular nor horizontal relative to axis C of transverse handle 63. As such, upright handle 64 is oblique relative to elongate member 40, and is oblique relative to transverse handle 63.

Accordingly, stand 21 includes elongate member 40 which extends upright along axis A from lower extremity 42 to upper extremity 41 connected to inner end 61 of arm 60, which is bent to the transverse portion or length of arm 60 formed with transverse handle 63, both of which extend along or are otherwise arranged about axis C that is slightly upturned in the direction of arrowed line B from horizontal. The transverse portion of arm extends outwardly and slightly upwardly to outer end 62 that is bent upright to upright handle 64 that slants slightly outwardly in the direction of arrowed line A away from axis A.

With continuing reference in relevant part to FIGS. 1-9, child-supporting assembly 22 is self-contained in that it is a complete and independent unit in and of itself, and is of unitary construction. Assembly 22 is configured to receive a child in a seated or sitting position, and includes support 80, seat 81 held by carrier 82 rigidly affixed to support 80, handles 83, and footrests 84. Support 80, carrier 82, handles 83, and footrests 84 define a framework, which is fashioned of a material or a combination of materials having the inherent properties of rigidity, strength, resilience, and impact-resistance, such as wood, plastic, and preferably steel, aluminum, or other metal, the various parts of which being welded together.

Support 80 is rotated to, or otherwise mounted for rotation to, elongate member 40 between upper extremity 41 and lower extremity 42. In this example, support 80 is elongate and tubular, and has upper end 80A and opposed lower end 80B and an overall length L2, denoted in FIGS. 6 and 7, from upper end 80A to lower end 80B of approximately 28 inches, which is more than half of overall length L1 of elongate member 40 from lower upper extremity 41 to lower extremity 42. Preferably, the overall length L2 of support 80 from upper end 80A to lower end 80B is no less than half the overall length L1 of elongate member from upper extremity 41 to lower extremity 42.

Elongate member 40 is inserted through support 80 from upper end 80A and through lower end 80B, and support 80 is free to rotate relative to elongate member 40 about axis A, which is the axis of rotation of support 80 and, more generally, assembly 22. Support 80 has a tubular inner diameter that relates to a corresponding cylindrical outer diameter of elongate support 40 to facilitate rotation of support 80 relative to elongate member 40. And so support 80, as is the case in this example, encircles elongate member 40 between upper extremity 41 and lower extremity 41. Upper end 80A of support 80 is directed toward upper extremity 41 of elongate member 40, and lower end 80B is directed toward lower extremity 42 of elongate member 40. Seat 81, which is preferably a padded seat, to receive a child in a sitting position is rigidly affixed to support 80 via fasteners, such as nut-and-bolt fasteners or the like, between upper and lower end 80A and 80B via carrier 82. Carrier 82 consists of horizontal member 90 and brace 91. Horizontal member 90 is rigidly affixed via welding to support 80 at an intermediate position relative to upper and lower ends 80A and 80B, and extends horizontally outward to seat 81, and brace 91 is rigidly connected between support 80 and horizontal member 90 for support. Specifically, brace 91 is rigidly affixed to support 80 between horizontal member 90 and lower extremity 42 of support 80, and extends angularly upwardly and outwardly to horizontal member 90 along the underside of seat 81 and is rigidly affixed to horizontal member 90 via welding. Handles 83 are rigidly affixed via welding to support 80 near upper end 80A and extend outwardly from either side of support 80 so as to be available to be taken up by hand by a child seated on seat 81. Footrests 84 are, in turn, rigidly affixed via welding to support 80 near lower end 80B and extend outwardly from either side of support 80 so as to be available to provide foot support for a child seated on seat 81. Handles 83 have rubberized or rubber-like applications or sleeves suitable for comfortable gripping by hand, and footrests 84 have rubberized or rubber-like applications or sleeves to provide non-slip foot support.

Support 80 is secured in place to elongate member 40 with retention collars 100 and 110 on elongate member 40 on either side of upper end 80A and lower end 80B, respectively, of support 80. Collar 100 at upper end 80A of support 80 is an upper collar, and collar 110 at lower end 80B of support 80 is a lower collar. Collars 100 and 110 are removably connected to elongate member 40 to captively retain support 80 therebetween so as to captively retain assembly 22 to stand 21.

Looking to FIGS. 10 and 11, collar 110 encircles elongate member 40 alongside lower end 80B of support 80 and is removably connected to elongate member 40 with set screws 111. Set screws 111 pass through corresponding threaded holes 112 of the outer object, which in this example is collar 110, and are tightened via rotation against the inner object, which in this example is elongate member 40, which removably connects collar 110 to elongate member 40. Collar 100 encircles elongate member 40 alongside upper end 80A of support 80 and is removably connected to elongate member 40 in the manner identical to that of collar 110, namely, with set screws 111 that pass through corresponding threaded holes of the outer object, which in this example is collar 100, and are tightened via rotation against the inner object, which in this example is elongate member 40, which removably connects collar 100 to elongate member 40.

As seen in FIGS. 10 and 11, bearing assembly 120 is coupled between lower end 80B of support 80 and collar 110, and interacts between lower end 80B of support 80 and collar 110 to facilitate support 80 rotation against the load of a child seated on seat 81. Bearing assembly 120 is captured between collar 110 and lower end 80B of support 80 and consists of washers 121 and 122 on elongate member 40 on either side of a bearing 123 on elongate member 40. Washers 121 and 122 and bearing 123 encircle elongate member 40. Washer 121 is positioned between lower end 80B of elongate member and bearing 123, and washer 122 is positioned between bearing 123 and collar 110, whereby bearing 123 is captured between washers 121 and 122. Bearing 123 is a conventional and readily available roller bearing in which lower end 80B of support 80 rotates.

Amusement apparatus 20 is useful in providing amusement and delight to a child, is employed between a child and an adult caregiver, and provides a child and the adult caregiver a unique opportunity for mutual interaction during playtime. To employ amusement apparatus 20 with reference to FIG. 12, transverse handle 63 and upright handle 64 are taken up by the respective hands of 130 in a standing position and amusement apparatus 20 is held upright locating boot 54 of foot assembly 50 formed in lower extremity 42 of elongate member 40 of stand 21 directly against supporting surface 131. The skid-resistant or non-slip material characteristic of boot 54 prevents boot 54 from slipping across supporting surface 131 during the use of amusement apparatus 20, according to the principle of the invention.

While holding amusement apparatus 20 upright, child 132 is seated onto seat 81 and takes up handles 83 by hand and positions feet on footrests 84. Child 22 may climb onto assembly 22 or be placed onto assembly 22 in the described seated or sitting position. While firmly gripping transverse and upright handles 63 and 64 and supporting amusement apparatus 20 in an upright position as shown with child 132 seated assembly 22, caregiver 130 commences to act on amusement apparatus 20 at transverse and upright handles 63 and 64 reciprocally pivoting amusement apparatus 20 back and forth at pivot point 43 formed in lower extremity 42 of amusement apparatus 20. Due to the offset orientation of seat 81 with respect to axis A of rotation of assembly 22 defined at axis A of elongate member 40, the described reciprocal pivoting applied to amusement apparatus 20 causes assembly 22 supporting child 132 to displace and rotate about axis A of elongate member 40 to provide amusement and fun for child 22. The self-contained, unitary construction of assembly 22 ensures that support 80, seat 81, carrier 82, handles 83, and footrests 84 remain stationary relative to each other as assembly 22 rotates, which ensures that seat 81, handles 83, and footrests 84 remain stationary relative to each other and are incapable of displacing or moving or rotating relative to each other or independently of each other, which ensures a safe and constant seated or sitting position of child 132 seated on assembly 22. The up-angled orientation of arm 60 and the relative orientation of transverse and upright handles 63 and 64 advantageously provide caregiver 131 comfortable gripping points and suitable leverage points to reciprocally pivot apparatus 20 at transverse and upright handles 63 and 64. As assembly 22 rotates, bearing assembly 120 bears the brunt of the weight applied across assembly 22 and facilities a smooth rotation of assembly 22 about axis A of elongate member 40.

The overall length of support 80 from upper end 80A to lower end 80B, which in this embodiment is no less than half the overall length of elongate member from upper extremity 41 to lower extremity 42, is sufficient to distribute the load of a child seated on assembly 22 across support 80 so as to prevent support 80 from binding against elongate member 40 under the weight of a child seated on assembly 22 in a seated or sitting position, which allows assembly 22 to function for its intended purposes, namely, to receive a child in a seated or sitting position and to rotate about elongate member 40 under the weight of a child seated on assembly 22 in the seated or sitting position so as to provide the child with amusement during the use of amusement apparatus 20.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. An amusement apparatus, comprising:

an elongate member includes an upper extremity and a lower extremity with a pivot point;

a child-supporting assembly is mounted to the elongate member for rotation thereabout between the upper extremity and the lower extremity;

a leveraging arm extends outwardly and away from the upper extremity of the elongate member to an outer end;

the leveraging arm has a transverse handle between the upper extremity of the elongate member and the outer end of the leveraging arm, and an upright handle at the outer end of the leveraging arm;

the leveraging arm is available to be taken up and held at the transverse handle and the upright handle to reciprocally pivot the elongate member at the pivot point formed in the lower extremity of the elongate member to impart rotation to the child-supporting assembly about the elongate member; and the pivot point is defined by a pivot joint formed in the lower extremity of the elongate member, the pivot joint comprises a linkage assembly coupled between the lower extremity of the elongate member and a foot positionable against a support surface.

2. An amusement apparatus according to claim 1, wherein the upright handle is positioned above the transverse handle.

3. An amusement apparatus according to claim 2, wherein the upright handle is oblique in relation to the transverse handle.

4. An amusement apparatus according to claim 1, wherein the foot comprises a flat, rigid plate including a top side coupled to the linkage assembly and an underside with a resilient, skid-resistant boot.

5. An amusement apparatus, comprising:

an elongate member includes an upper extremity and a lower extremity with a pivot point;

a child-supporting assembly, including a seat to receive a child in a sitting position and handles available to be taken up by hand by a child seated on the seat, is mounted to the elongate member for rotation thereabout between the upper extremity and the lower extremity;

a leveraging arm extends outwardly and away from the upper extremity of the elongate member to an outer end;

the leveraging arm has a transverse handle between the upper extremity of the elongate member and the outer end of the leveraging arm, and an upright handle at the outer end of the leveraging arm; and the leveraging arm is available to be taken up and held at the transverse handle and the upright handle to reciprocally pivot the elongate member at the pivot point formed in the lower extremity of the elongate member to impart rotation to the child-supporting assembly about the elongate member.

6. An amusement apparatus according to claim 5, wherein the upright handle is positioned above the transverse handle.

7. An amusement apparatus according to claim 6, wherein the upright handle is oblique in relation to the transverse handle.

8. An amusement apparatus according to claim 5, wherein the pivot point is defined by a pivot joint formed in the lower extremity of the elongate member, the pivot joint comprises a linkage assembly coupled between the lower extremity of the elongate member and a foot positionable against a support surface.

9. An amusement apparatus according to claim 8, wherein the foot comprises a flat, rigid plate including a top side coupled to the linkage assembly and an underside with a resilient, skid-resistant boot.

10. An amusement apparatus, comprising:

an elongate member includes an upper extremity and a lower extremity with a pivot point;

a child-supporting assembly, including a seat to receive a child in a sitting position and footrests available to provide foot support for a child seated on the seat, is mounted to the elongate member for rotation thereabout between the upper extremity and the lower extremity;

a leveraging arm extends outwardly and away from the upper extremity of the elongate member to an outer end;

the leveraging arm has a transverse handle between the upper extremity of the elongate member and the outer end of the leveraging arm, and an upright handle at the outer end of the leveraging arm;

the leveraging arm is available to be taken up and held at the transverse handle and the upright handle to reciprocally pivot the elongate member at the pivot point formed in the lower extremity of the elongate member to impart rotation to the child-supporting assembly about the elongate member; and the pivot point is defined by a pivot joint formed in the lower extremity of the elongate member, the pivot joint comprises a linkage assembly coupled between the lower extremity of the elongate member and a foot positionable against a support surface.

11. An amusement apparatus according to claim 10, wherein the upright handle is positioned above the transverse handle.

12. An amusement apparatus according to claim 11, wherein the upright handle is oblique in relation to the transverse handle.

13. An amusement apparatus according to claim 10, wherein the foot comprises a flat, rigid plate including a top side coupled to the linkage assembly and an underside with a resilient, skid-resistant boot.

* * * * *